US008770004B2

(12) United States Patent
Yuri et al.

(10) Patent No.: US 8,770,004 B2
(45) Date of Patent: Jul. 8, 2014

(54) ROLLING MILL ROLL AND ROLLING MILL MACHINE

(75) Inventors: Koichi Yuri, Anpachi-gun (JP); Mitsuhiro Takatsuki, Anpachi-gun (JP); Eiji Ogura, Anpachi-gun (JP)

(73) Assignee: Mitsubishi Materials Corporation, Tokyo (JP)

( * ) Notice: Subject to any disclaimer, the term of this patent is extended or adjusted under 35 U.S.C. 154(b) by 629 days.

(21) Appl. No.: 12/451,615

(22) PCT Filed: May 16, 2008

(86) PCT No.: PCT/JP2008/059008

§ 371 (c)(1),
(2), (4) Date: Apr. 5, 2010

(87) PCT Pub. No.: WO2008/143161

PCT Pub. Date: Nov. 27, 2008

(65) Prior Publication Data

US 2010/0187344 A1 Jul. 29, 2010

(30) Foreign Application Priority Data

May 21, 2007 (JP) ..... 2007-134160

(51) Int. Cl.
*B21B 31/00* (2006.01)

(52) U.S. Cl.
USPC ..... 72/237; 72/252.5; 72/249

(58) Field of Classification Search
USPC ..... 72/237, 252.5, 249; 492/47, 27, 38
See application file for complete search history.

(56) References Cited

U.S. PATENT DOCUMENTS 3,866,283 A * 2/1975 Gould ..... 492/60
4,881,310 A * 11/1989 Wykes et al. ..... 492/1
5,647,831 A * 7/1997 Schroeder ..... 492/38
5,782,125 A * 7/1998 Faggiani et al. ..... 72/237
5,934,131 A * 8/1999 Shen ..... 72/252.5
2009/0280972 A1* 11/2009 Ogura et al. ..... 492/1
2011/0075956 A1* 3/2011 Wojtkowski, Jr. ..... 384/276

FOREIGN PATENT DOCUMENTS

DE 2536354 A1 3/1976
EP 0049771 A2 4/1982
JP 58-038602 A 3/1983
JP 3-154 4/1983

(Continued)

OTHER PUBLICATIONS

International Search Report mailed Aug. 12, 2008, issued on PCT/JP2008/059008.

(Continued)

*Primary Examiner* — Bena Miller
(74) *Attorney, Agent, or Firm* — Edwards Wildman Palmer LLP

(57) ABSTRACT

The present invention is to provide a rolling mil roll including a rolling mill ring and a metal base in which a tensile stress applied to the rolling mill ring located along the outer circumferential face side is reduced; and then cracks thereon are prevented from occurring.

The rolling mill roll 10 includes:

the rolling mill roll 11 made of cemented carbide having rolling sections 13 on its outer circumferential face 11*a;* and the metal base 12 located on the inner circumferential face of the rolling mill roll 11.

The circumferential interface 14, where the rolling mill ring 11 and the metal base 12 face each other, is fixed radially around its axis L by a contact pressure derived from a fitting section, and also is bound with an adhesive agent M.

4 Claims, 6 Drawing Sheets

(56) References Cited

FOREIGN PATENT DOCUMENTS

| | | |
|---|---|---|
| JP | 59-135806 | 9/1984 |
| JP | 63-168207 A | 7/1988 |
| JP | 64-5702 | 1/1989 |
| JP | 10-024303 A | 1/1998 |
| JP | 3116040 | 2/2000 |
| JP | 2004-050216 A | 2/2004 |

OTHER PUBLICATIONS

The extended European search report dated Apr. 19, 2013 for corresponding European Patent Application No. 08752859.2.

* cited by examiner

ROLLING MILL ROLL AND ROLLING MILL MACHINE

TECHNICAL FIELD

This invention relates to rolling mill rolls and rolling mill machines used for hot rolling processes of making wires and/or rods.

BACKGROUND ART

In typical continuous production of wires and/or rods from materials such as metals, continuous rolling processes are widely used for working metal materials as the workpiece, using a rolling mill roll providing rolling section[s], namely, molding groove[s], on its outer circumferential face.

A rolling mill machine, in which one end of its roll shaft connects to a rotor shaft of an electric motor, is used for such rolling mill processes. This type of rolling mill machine is called an overhung type rolling mill machine.

In continuous rolling processes using such rolling mill machines, in order to make the surface of the products (wires and/or rods) smooth, a rolling mill roll made of cemented carbide is removably attached onto the outer circumference of the roll shaft. (For example, see Patent Document 1.)

FIG. 5 shows an example of this overhung type rolling mill machine.

This rolling machine 1, is formed of materials such as steel, has a roll shaft 2 having an approximately cylindrical shape which goes along the direction of an axis L, and is an overhung type rolling mill machine 1 in which a one end side (left side in FIG. 5) of the roll shaft 2 connects to a rotor axis (not shown in FIG. 5).

A reduced diameter end section 4 formed in cylindrical tiers, is located at an other end side, (right side in FIG. 5) of the roll shaft 2.

A tapered shaft section 3 is located on the one end side of the reduced diameter end section 4. The diameter of the tapered shaft section 3 becomes gradually smaller in a direction of the other end side.

A tapered sleeve 5 having a tapered hole 6 able to fit with the tapered shaft section 3, is inserted from the other end side of the tapered shaft section 3.

The outer circumferential face of the tapered sleeve 5 is a cylindrical face parallel to an axis L.

The thickness of the tapered sleeve 5 decreases gradually in a direction of the one end side.

Also, an inserting hole 7, which goes coaxially along the taper hole 6, is bored on the other end side of the tapered sleeve 5. The reduced diameter end section 4 of the roll shaft 2 is inserted into the inserting hole 7.

A rolling mill roll 8 having an approximate ring shape integrally formed of cemented carbide is mounted on the outer circumferential face of the tapered sleeve 5.

A rolling mill section 9;

is provided on the outer circumferential face of the rolling mill roll 8, is located at the middle length position of this rolling mill roll 8 in a direction of the axis L, and has a semicircular shape concavely curved radially inward in a cross-section view.

The inner circumferential face of the rolling mill roll 8 is a cylindrical face parallel to the axis L.

Moving the tapered sleeve 5 mounted on the roll shaft 2 toward the one end side, the tapered shaft section 3 makes the tapered sleeve 5 expand and reshape radially outward.

Then, the tapered sleeve 5 presses the inner circumferential face of the rolling mill roll 8 and also makes it expand radially outward. Therefore the rolling mill roll 8 is fixed on the outer circumferential face of the tapered sleeve 5.

A taper fitting method fixes the tapered sleeve 5 on the tapered shaft section 3. Thus, the rolling machine 1 comprises the roll shaft 2, the tapered sleeve 5 and the rolling mill roll 8 as a single unit.

Different from the aforementioned rolling mill roll 8 integrally formed of cemented carbide, a rolling mill, in which the use of expensive cemented carbide on the rolling mill is reduced in order to cut down its total production cost, is known.

In such rolling mill, only a ring shaped outer circumferential face, which comes in contact with a workpiece while a rolling mill process is in operation, is made of cemented carbide.

To assemble this rolling mill, a ring made of cast iron is wedged into the inner circumferential region of the above cemented carbide ring:

a steel material having a cylindrical shape is cooled, and then inserted into the inner circumferential region of the above cast iron ring:

and afterward these components are heated for integrating them as a single unit.

(For an example, see Patent Document 2.)

[Patent Document 1]

Japanese Patent No. JP 3116040

[Patent Document 2]

Japanese Examined Patent Application JP H03-000154B2

DESCRIPTION OF THE INVENTION

Problem(s) to be Solved by the Invention

In the rolling mill machine using the rolling mill roll mentioned in the Patent Document 1, the tapered sleeve 5 presses radially outward the inner circumferential face of the rolling mill roll 8 made of cemented carbide. I.e., the tapered sleeve 5 pushes up radially outward the rolling mill roll 8 to fix it. Thus a tensile stress is applied circumferentially along the outer circumferential face of the rolling mill roll 8.

Since cemented carbide is generally weak against a tensile stress, cracks tend to occur on the outer circumferential face of the rolling mill roll 8.

In order to prevent cracking, the radial thickness of the rolling mill roll 8 should be increased to ensure its rigidity.

In this case, the portion actually used for rolling mill operation becomes relatively smaller against the rolling mill roll 8 as a whole. Therefore the amount of the cemented carbide used for the rolling mill roll becomes excessively large, and accordingly, the production cost of the rolling mill roll 8 rises significantly.

On the other hand, in the rolling mill roll mentioned in the Patent Document 2, only the ring shaped outer circumferential face, which comes in contact with the workpiece while a rolling mill process is in operation, is only made of cemented carbide; thus its production cost can be reduced.

However, to assemble this rolling mill roll, the cast iron ring is wedged into the ring shaped cemented carbide, then the cylindrical steel is cooled and fitted into the inner circumferential region of the above cast iron ring. Therefore, fitting sections, namely, shrink ranges for fitting both inner and outer faces, must be provided for the two steps, i.e., for the wedging step and, for the cooling and fitting step. After the above procedure, the two rings can become securely a single unit.

However, a surface pressure applied on the inner circumferential face of the rolling mill ring also can become intensive. Thus, a large tensile stress is applied circumferentially along the outer circumferential face of the rolling mill ring.

Therefore, if the rolling mill roll mentioned in the Patent Document 2 is fixed on the roll shaft 2 of the rolling mill machine 1 mentioned in the Patent Document 1, the inner circumferential face of the rolling mill roll is pressed and expanded radially outward. Further, the tensile stress applied to the rolling mill ring significantly increases, and then cracks tend to occur.

Once cracks occur on the outer circumferential face of the rolling mill roll, materials such as metals enter the cracks. Thus, the rolling mill operation cannot be conducted in good condition, and also the widening cracks may damage the rolling mill roll itself. Therefore, in case the cracks occur, a prompt replacement of the rolling mill roll is required as soon as possible; thus undesirable and significant increase in the running costs of the rolling mill machine can arise.

The present inventors have recognized the aforementioned subjects, and the present invention is to provide a rolling mill roll and a rolling mill machine wherein

- the rolling mill roll is integrally comprised of a rolling mill ring and a metal base;
- the two rings, namely, the rolling mill ring and the metal base become a single unit firmly;
- a tensile stress applied to a rolling mill ring located along an outer circumferential face side is reduced; and
- cracks can be prevented from occurring on the outer circumferential face of a rolling mill ring, even if the rolling mill roll is used with an overhung type rolling mill machine.

In other words, the cracks can be prevented, even if an inner circumferential face of the rolling mill roll is pressed radially when fixing the rolling mill roll on this overhung type rolling mill machine for using them together.

Technical Solution

In order to solve the aforementioned matters, the present invention shows the following subjects.

A rolling mill roll, which is related to the present invention, includes

- a rolling mill ring made of cemented carbide having one or more rolling sections for milling workpiece on its outer circumferential face; and
- a ring shaped metal base located in an inner circumferential region of the rolling mill ring.

A circumferential interface, where the rolling mill ring and the metal base face each other,

- is fixed radially around its axis by a contact pressure derived from a fitting section, and also
- is bound with an adhesive agent.

The fitting section is formed at the circumferential interface where the inner circumferential face of the rolling mill ring and the outer circumferential face of the metal base touch each other. A static surface pressure at the circumferential interface is maintained by the contact pressure derived from the fitting section. The adhesive agent is also applied to the circumferential interface.

Therefore, strength of the contact pressure by the surface pressure together with adhesion strength of the adhesive agent, make the rolling mill ring and the metal base a single unit securely.

Also, even if the fitting section is not too large sized, the adhesion strength of the adhesive agent is sufficient to make up for the strength derived from such fitting section, and can make the rolling mill ring and the metal base the single unit securely.

Therefore, an excessive contact pressure will not be added radially outward, and then a large tensile stress is not applied to the rolling mill ring located on the outer circumferential face section.

Furthermore, in the present invention, a rolling mill roll; in which the circumferential interface,

- is a tapered face which slopes to the axis, and
- is fixed with the contact pressure by wedging the metal base into the rolling mill ring;

is also usable.

By wedging the metal base into the rolling mill ring to fit them each other, the fitting section formed at the inner circumferential face of the rolling mill and/or at the outer circumferential face of the metal base makes and maintains the static surface pressure at the circumferential interface; and thus the rolling mill ring and the metal base can become the single unit.

Since the circumferential interface has the tapered shape which slopes to the axis, the contact surface of such circumferential interface becomes larger than that of a circumferential interface which is parallel to the axis. Therefore, the surface area, where the adhesive agent can be applied, increases. Accordingly, the adhesion strength of the adhesive agent can become greater.

Furthermore, inserting the metal base having a tapered shaped outer circumferential face, which slopes to the axis, into the rolling mill ring having also a tapered shaped inner circumferential face, which also slopes to the axis;

the adhesive agent at the circumferential interface does not come off, but spreads evenly.

Thus, the sufficient adhesion strength of the adhesive agent can be well maintained.

Furthermore, in the present invention, a rolling mill roll; in which

- a taper angle, at which the circumferential interface slops to the axis,
- is in the range of 0°10' to 2°00';

is suitable.

If the taper angle is less than 0°10', the adhesive agent layer will come off when inserting the metal base into the rolling mill ring. Thus, the sufficient adhesion strength of the adhesive agent cannot be well maintained.

On the other hand, results of measurements in experiments show clearly that the taper angle of greater than 2°00' did not give sufficient adhesion strength. From the above facts, the taper angle determined in the range of 0°10' to 2°00' makes the adhesion strength of the adhesive agent sufficient, and can make the rolling mill ring and the metal base the single unit securely.

Additionally, a methacrylate resin type adhesive agent is suitable as the adhesive agent for the rolling mill ring.

This type of adhesive agent has such great adhesive strength as its shear strength is 19.6N/mm$^2$ or higher. Also this type is an anaerobic type adhesive agent which will harden rapidly under anaerobic conditions, and then yields such great adhesive strength.

Therefore, this type of adhesive agent can make the rolling mill ring and the metal base the single unit more rapidly and securely.

In the present invention, a rolling mill machine comprises a tapered shaft section, which rotates on its axis, and a tapered sleeve.

The tapered sleeve has a tapered inner circumferential face, and is mounted on the tapered shaft section. The rolling mill roll is mounted coaxially on the outer circumferential face of the tapered sleeve.

The mechanism for fixing the rolling mill roll on the outer circumferential face of the tapered sleeve is that:

when mounting the tapered sleeve on the rolling mill machine, the tapered shaft section makes the tapered sleeve expand and reshape radially outward, and then the tapered sleeve presses the inner circumferential face of the rolling mill roll and also makes it expand radially outward.

In the rolling mill roll relating to the present invention, even if the fitting section formed between the inner circumferential face of the rolling mill roll and the outer circumferential face of the metal base is not too large sized, the adhesion strength of the adhesive agent is sufficient to make up for the strength derived from such fitting section, and can make the rolling mill ring and the metal base the single unit securely.

Thus an excessive tensile stress will not be applied to the rolling mill ring located on the outer circumferential face section.

Therefore, even if the tapered shaft section presses radially outward the rolling mill roll, no cracks will occur on the outer circumferential face of the rolling mill roll.

Advantageous Effects

In a rolling mill roll comprised of a rolling mill ring and a metal base as the single unit, the present invention produces the following effects:

a fitting section formed at the circumferential interface and an adhesive agent applied thereto

- can make the rolling mill ring and the metal base the single unit securely;
- can reduce a tensile stress applied to the rolling mill ring located on the outer circumferential face section; and
- can prevent the outer circumferential face of the rolling mill roll from cracking, even if the rolling mill roll is used with an overhung type rolling mill machine.

In other words, the outer circumferential face of the rolling mill roll can be prevented from cracking, even if the inner circumferential face of the rolling mill roll is pressed radially outward when fixing the rolling mill roll on this overhung type rolling mill machine for using them together.

REFERENCE NUMERALS

10: ROLLING MILL ROLL
11: ROLLING MILL RING
12: METAL BASE
13: ROLLING SECTION
14: CIRCUMFERENTIAL INTERFACE
20: ROLLING MILL MACHINE
23: TAPERED SHAFT SECTION
24: TAPERED SLEEVE
L: AXIS
M: ADHESIVE AGENT
θ: TAPER ANGLE

BEST MODE FOR CARRYING OUT THE INVENTION

Referring FIGS. 1 and 2, embodiments of the rolling mill roll and rolling mill machine relating to the present invention are detailed in the following descriptions.

Figure 1:
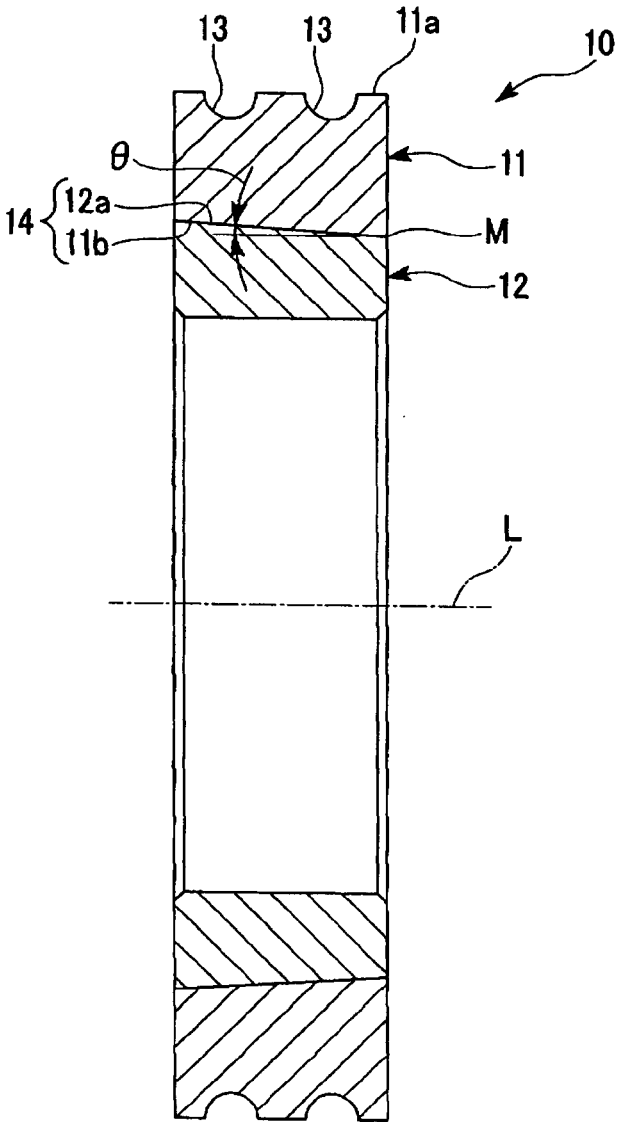
FIG. 1 is a cross sectional view of the rolling mill roll in accordance with an embodiment of the present invention.

FIG. 1 shows a rolling mill roll as one of the embodiments relating to the present invention.

Figure 2:
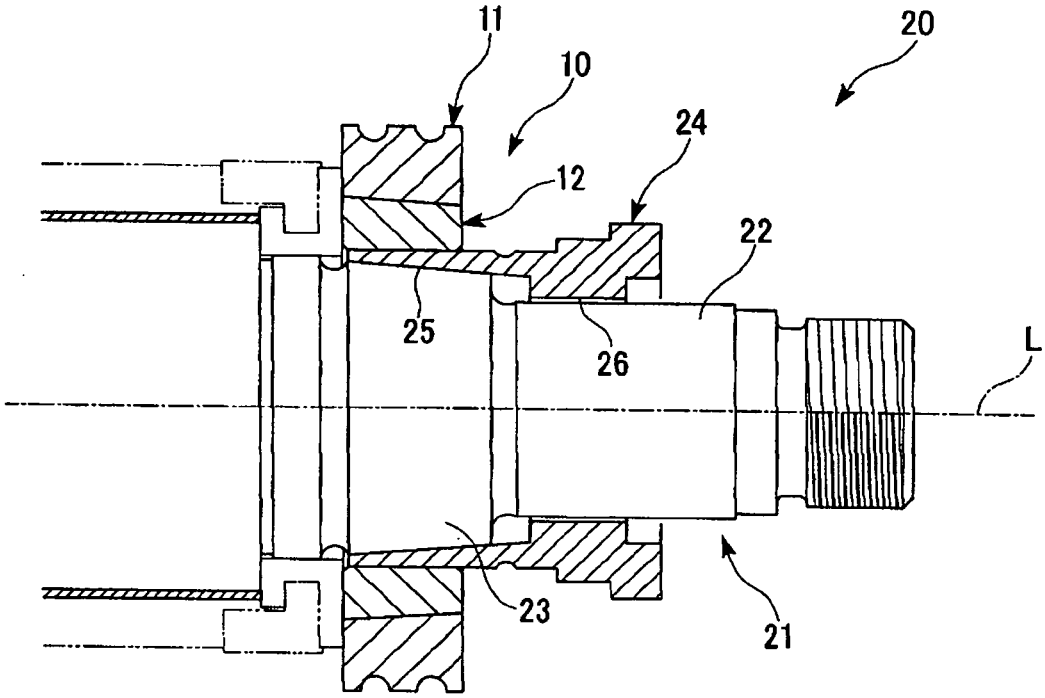
FIG. 2 is a cross sectional view of the rolling mill machine in accordance with the embodiment of the present invention.

FIG. 2 shows a rolling mill machine as one of the embodiments relating to the present invention.

A rolling mill roll 10 comprises two rings, namely, a rolling mill ring 11 located on the outer circumferential face side of this rolling mill roll and a metal base 12 located on the inner circumferential side of this rolling mill roll.

The rolling mill roll 11 having an approximate cylindrical shape is integrally formed of cemented carbide. On an outer circumferential face 11*a* of the rolling mill roll, two rolling sections 13 are provided for working metal materials as workpiece in rolling processes.

An inner circumferential face 11*b* of the rolling mill roll 11 has a tapered shape, in which its radial diameter becomes gradually smaller in the direction from the one end to the another end. A taper angle θ, that is the angle between an axis L and the inner circumferential face 11*b*, is determined in the range of 0°10' to 2°00'.

The metal base 12, is made of materials such as steel, and has an approximately cylindrical shape wherein its length parallel to the axis L is equal to that of the rolling mill roll 11.

Further, its outer circumferential face 12*a* has a tapered shape in which its radial diameter becomes gradually smaller in the direction from the one end to the another end, and its taper angle θ is equal to that of the rolling mill roll 11. The average external diameter of the metal base 12 is in slight excess of the average internal diameter of the rolling mill roll 11. For example, this excess is determined within the range of 0.01% to 0.1% of the average internal diameter.

To make the rolling mill ring 11 and the metal base 12 a single unit; firstly, a methacrylate resin type adhesive agent M is applied on both the inner circumferential face 11*b* of the rolling mill roll 11 and the outer circumferential face 12*a* of the metal base 12. When doing this work, desirably the adhesion agent M should be applied as even as possible on both of the inner circumferential face 11*b* and the outer circumferential face 12*a*.

Additionally, an adhesion agent having a shear strength of 4.9 $N/mm^2$ or higher is desirable for the adhesion agent M. For example, a methacrylate resin type adhesive agent, its chief ingredient is a methacrylate ester, is suitably used as the adhesion agent M.

After such preparations, the small external diameter end of the metal base 12 is inserted into the large internal diameter end of the rolling mill roll 11, and thus the metal base 12 is fitted with the inner circumferential face of the rolling mill roll 11.

After the inner circumferential face 11*b* of the rolling mill roll 11 and the outer circumferential face 12*a* of the metal base 12 have touched each other, further pressure is continuously applied in the inserting direction, and then the metal base 12 is wedged into the inner circumferential face 11*b* of the rolling mill roll 11. The determined average external diameter of the metal base 12 is slightly lager than the average internal diameter of the rolling mill roll 11, to form a stable fitting section at a circumferential interface 14 where the two rings 11 and 12 touch each other.

After the wedging operation makes both end faces of the rolling mill ring 11 and of the metal base 12 form a single plane on both sides, the rolling mill roll 10, in which both of the contact pressure derived from the fitting section and the adhesion strength of the adhesive agent M made the inner circumferential face 11*b* of the rolling mill roll 11 and the outer circumferential face 12*a* of the metal base 12 the single unit, has been completely formed.

To use the rolling mill roll 10 having the above configuration together with an overhung type rolling mill machine 20 shown in FIG. 2, the rolling mill roll is fixed on the overhung type rolling mill machine 20.

The overhung type rolling mill machine 20 includes a roll shaft 21 having an approximately cylindrical shape which goes along the axis L.

A one end side (left side in FIG. 2) of the roll shaft 21 connects to a rotor shaft (not shown in FIG. 2).

A reduced diameter end section 22, formed in cylindrical tiers, is located on an other end side (right side in FIG. 2) of the roll shaft 21.

A tapered shaft section 23 is located on a one end side of the reduced diameter end section 22. The diameter of the tapered shaft section 23 becomes gradually smaller in a direction of the other end side.

A tapered sleeve 24 made of materials such as steel has a tapered hole 25 able to fit with the tapered shaft section 23. The tapered sleeve 24 is inserted from the other end side of the tapered shaft section 23.

The outer circumferential face of the tapered sleeve 24 is a cylindrical face parallel to the axis L.

The thickness of the tapered sleeve 24 decreases gradually in the direction of the one end side.

Also, an inserting hole 26, which goes coaxially along the taper hole 25, is bored on the other end side of the tapered sleeve 24. The reduced diameter end section 22 of the roll shaft 21 is inserted into the inserting hole 26.

The rolling mill roll 10 is mounted on the outer circumferential face of the tapered sleeve 24.

Wedging the tapered sleeve 24 in the direction of the one end, the tapered shaft section 23 makes the tapered sleeve 24 expand and reshape radially outward, and then the tapered sleeve 24 presses the inner circumferential face of the rolling mill roll 10 and also makes it expand radially outward.

Thus, the rolling mill roll 10 is fixed on the outer circumferential face of the tapered sleeve 24.

Therefore, while a continuous rolling process is on, revolution of a rotor shaft rotates the roll shaft 21, the tapered sleeve 24, and the rolling mill roll 10 all together; and then the rolling sections 13 of the rolling mill roll 10 work metal materials as the workpiece.

The rolling mill roll 10 in this embodiment is the single unit comprised of two components, namely, the rolling mill ring 11 and the metal base 12.

Since the determined average external diameter of the metal base 12 is slightly lager than the average internal diameter of the rolling mill roll 11, the fitting section is formed at the circumferential interface 14 where the inner circumferential face 11*b* of the rolling mill roll 11 and the outer circumferential face 12*a* of the metal base 12 touch each other.

Therefore, since the outer circumferential face 12*a* of the metal base 12 presses the inner circumferential face 11*b* of the rolling mill roll 11 and also makes it expand radially outward, a static and uniform surface pressure is circumferentially applied on the inner circumferential face 11*b* of the rolling mill roll 11.

The adhesion agent M is also applied to the circumferential interface 14. Thus, strength of the contact pressure by the surface pressure and the adhesion strength of the adhesive agent M make the two rings the single unit securely.

Since not only the fitting section between the rolling mill roll 11 and the metal base 12 but also the adhesion agent M make the rolling mill roll 10 the single unit securely; even if the fitting section is not too large sized, the adhesion strength of the adhesive agent M is sufficient to make up for the strength derived from such fitting section. Therefore, a high strength of the surface pressure will not be added radially outward, and also a large tensile stress will not be applied to the rolling mill ring located on the outer circumferential face section.

The circumferential interface 14, where the inner circumferential face 11*b* of the rolling mill roll 11 and the outer circumferential face 12*a* of the metal base 12 touch each other, is a tapered face.

When engaging the rolling mill ring 11 and the metal base 12 by a taper fitting method, the fitting section formed between the rolling mill ring 11 and the metal base 12 secures a surface pressure, and also this surface pressure yields the contact pressure which makes the rolling mill roll 11 and the metal base 12 the single unit.

Further, since the circumferential interface 14 slopes to the axis L, its surface becomes larger than that of a circumferential interface which is parallel to the axis L. Therefore, the surface area, where the adhesion agent M can be applied, increases. Further, the metal base 12, in which its outer circumferential face 12*a* is a tapered shape, namely, a sloped shape, is fitted with the rolling mill roll 11, in which its inner circumferential face 11*b* is also a sloped shape. Therefore, the adhesive agent M on either face does not come off compared with a straight fitting in which both faces are straight cylindrical shapes.

Further, in the rolling mill roll 10, the taper angle θ between the axis and the circumferential interface 14 is determined in the range of 0°10' to 2°00'. At the circumferential interface 14, the inner circumferential face 11*b* of the rolling mill roll 11 and the outer circumferential face 12*a* of the metal base 12 touch each other.

If the taper angle θ is extremely narrow such as less than 0°10'; in this case, the shape becomes almost similar to the straight fitting, the layer of the adhesive agent M comes off when inserting the metal base 12 into the rolling mill ring 11. Thus, the sufficient adhesion strength of the adhesive agent cannot be well maintained.

On the other hand, if the taper angle is greater than 2°00'; the below mentioned results of a measurement in an experiment shows clearly that the gained strength was not sufficient.

Therefore, the determined taper angle θ in the range of 0°10' to 2°00' can make the rolling mill ring 11 and the metal base 12 the single unit securely.

Additionally, in this embodiment, a methacrylate resin type adhesive agent is used as the adhesive agent M.

The methacrylate resin type adhesive agent has such a great adhesive strength as its shear strength is 19.6N/mm$^2$ or higher. Also this type adhesive agent is an anaerobic type adhesive agent which will harden rapidly under anaerobic conditions, and then yields such great adhesive strength. Therefore, this type of adhesive agent can make the rolling mill ring 11 and the metal base 12 the single unit rapidly and more securely.

When fixing the rolling mill roll 10 on the rolling mill machine 20, the tapered shaft section 23 makes the tapered sleeve 24 expand and reshape radially outward, and then the tapered sleeve 24 presses the inner circumferential face of the rolling mill roll 10 and also makes it expand radially outward. Thus the rolling mill roll 10 is fixed on the outer circumferential face of the tapered sleeve 24. On the other hand, if the fitting section formed between the inner circumferential face 11*b* of the rolling mill roll 11 and the outer circumferential face 12*a* of the metal base 12 is not too large sized, the adhesion strength of the adhesive agent M between them is sufficient to make up for the strength derived from such fitting section, and can make the rolling mill ring 11 and the metal base 12 the single unit securely. Thus, a large tensile stress cannot be applied to the rolling mill ring 11 located on the outer circumferential face of the rolling mill roll 10.

Therefore, even if a pressure is applied radially outward by the tapered sleeve 24, no cracks can occur on the outer circumferential face of the rolling mill ring 11.

In the rolling mill roll 10 comprised of the rolling mill ring 11 and the metal base 12 as the single unit, the aforementioned descriptions show that:

the fitting section formed at the circumferential interface 14, and also the adhesive agent M applied to the circumferential interface 14 can make the rolling mill ring 11 and the metal base 12 the single unit securely;

if the fitting section is not too large sized, the sufficient strength for fixing them is obtained by the strength derived from such fitting section together with the adhesive agent M; and then a surface pressure applied on the inner circumferential face 11*b* of the rolling mill ring 11 is released, and also the tensile stress applied to the rolling mill ring 11 can be reduced.

Therefore, an occurrence of cracks can be prevented, even if the rolling mill roll 10 is used with the rolling mill machine 20 that is an overhung type rolling mill machine.

In other words, the occurrence of cracks can be prevented, even if the inner circumferential face of the rolling mill roll 10 is pressed radially outward when fixing the rolling mill roll 10 on this overhung type rolling mill machine for using them together.

The taper fitting method, by which the rolling ring 11 and the metal base 12 are fitted to each other, also allows to apply larger quantities of the adhesive agent M to both inner and outer tapered faces; and thus its adhesion strength can become greater.

Further, when inserting the metal base into the rolling mill ring, the adhesive agent M does not come off but spreads evenly. Therefore, the sufficient adhesion strength of the adhesive agent M can be well maintained.

Furthermore, the taper angle for fitting is determined in the range of 0°10' to 2°00', and the use of a methacrylate resin type adhesive agent as the adhesive agent M can make the rolling mill ring 11 and the metal base 12 the single unit securely.

The rolling mill roll 10 is usable for the overhung type rolling mill machine 20, even if the inner circumferential face of the rolling mill roll 10 is pressed radially when fixing the rolling mill roll 10 on the rolling mill machine 20. Therefore, a conventional rolling mill roll, that is a rolling mill having a thicker radial thickness and integrally formed of cemented carbide, need not be used. Thus, the production cost of the rolling mill machine 20 can be greatly reduced.

The rolling mill roll 10 in this embodiment has a configuration wherein the rolling mill ring 11 made of cemented carbide, which is very heavy, is used limitedly for only an outer circumferential section.

Therefore, the total weight of the rolling mill roll 10 is lighter than that of a rolling mill roll integrally formed of cemented carbide. Thus, the rolling mill roll becomes easy to handle.

Further, the metal base 12 in the rolling roll 10 is made of steel.

In such cases, the tapered sleeve 24 and the tapered shaft section 23 are also made from steel as is the rolling mill machine 20 mentioned in this embodiment, a friction against the tapered sleeve 24 becomes greater than that of a rolling mill roll integrally formed of cemented carbide. This friction can prevent the tapered sleeve 24 from rotationally slipping.

Although the aforementioned explanations detail the rolling mill roll 10 and the embodiment of the rolling mill machine 20, which are of the present invention; the invention is not limited to them without departing from the technical scheme of this invention.

Figure 3:
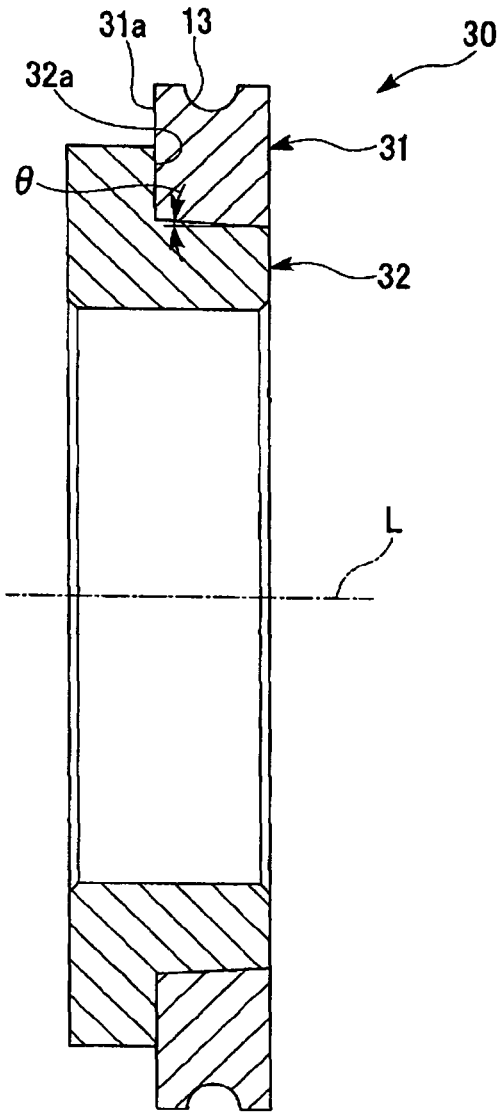
FIG. 3 shows an example for a first variation of the rolling mill roll in accordance with the embodiment.

FIG. 3 shows a rolling mill roll 30, an example of the first variation, in which only one rolling section 13 is provided on a rolling mill ring 31, its length parallel to the axis L is longer than that of the rolling mill ring 31, a metal base 32 has an abut face 32*a*, and the abut face 32*a* abuts an end face 31*a* of the rolling mill ring 31 in a state that the rolling mill ring 31 is mounted on the metal base 32.

This rolling mill roll 30 is usable for a rolling mill roll, too.

In this variation, the adhesion agent M can be applied to the end face 31*a* of the rolling mill ring 31 and to the abut face 32*a* of the metal base 32, as well as to the tapered faces. Therefore, adhesion strength between the rolling mill ring 31 and the metal base 32 can be enhanced.

Figure 4:
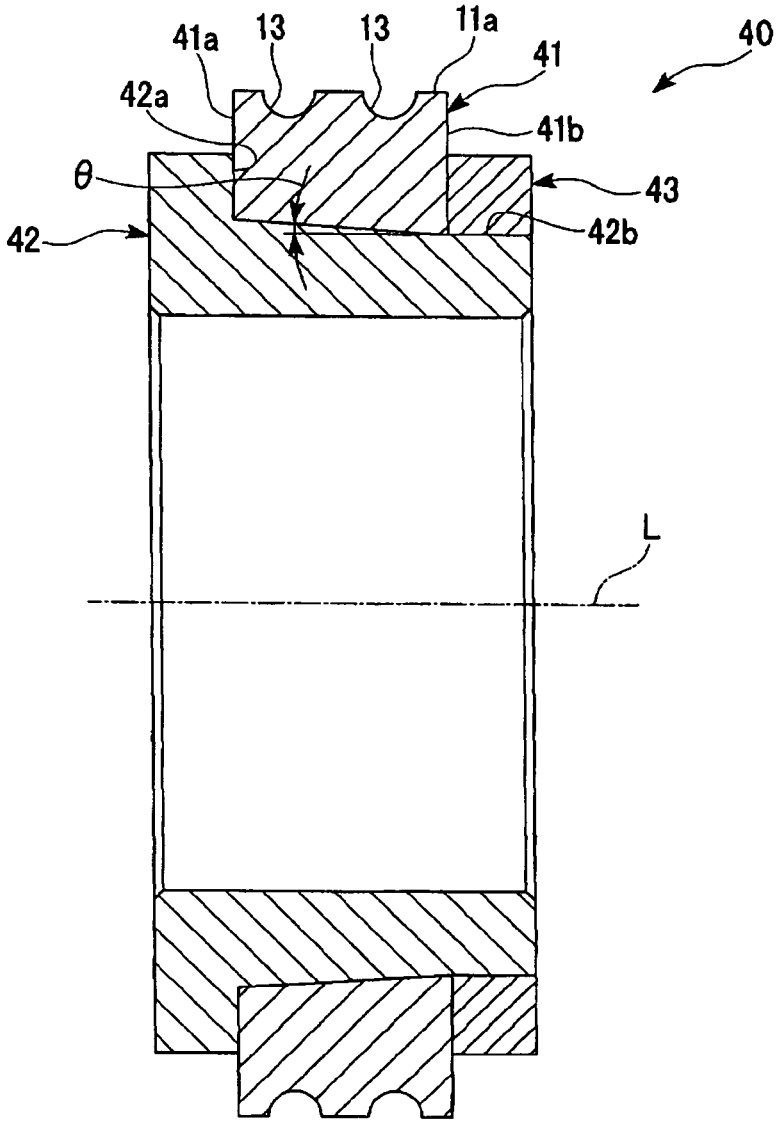
FIG. 4 shows an example for a second variation of the rolling mill roll in accordance with the embodiment.
Figure 5:
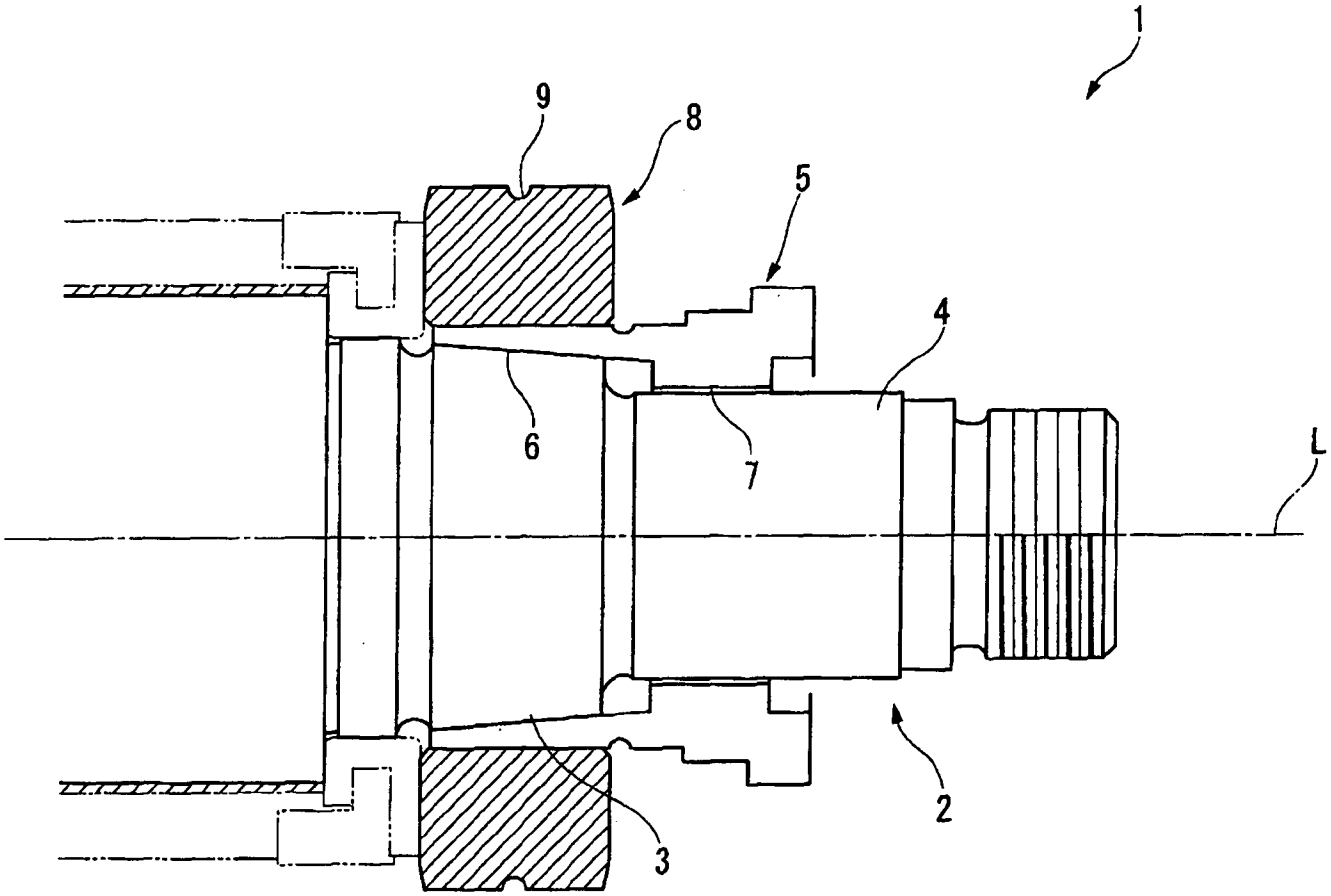
FIG. 5 is a cross sectional view of the rolling mill roll and rolling mill machine in accordance with the conventional arts.

FIG. 4 shows a rolling mill roll 40, an example of the second variation, in which a length of a metal base 42 parallel to the axis L is longer than that of a rolling mill ring 41, an one end face 41*a* of the rolling mill ring 41 abuts on an abut face 42*a* of the metal base 42, an other end face 41*b* of the rolling mill ring 41 abuts an abut ring 43, and the abut ring 43 is put on a reduced diameter end section 42*b* of the metal base 42.

This rolling mill roll 40 is usable for a rolling mill roll, too.

In this variation, the side pressures applied to the rolling mill ring 41 from both sides in the direction of the axis L and the adhesion strength of the adhesion agent M, can fix the rolling mill ring 41, and can make this rolling mill roll the single unit securely.

In the present aforementioned embodiments, the circumferential interface 14 is a tapered face.

By wedging the metal base 12 into the rolling mill ring 11, a fitting section formed at the circumferential interface 14 makes a contact pressure, and then the contact pressure fixes the rolling mill ring 11 on the metal base 12.

On the other hand, the circumferential interface 14, which are not tapered faces but just cylindrical faces parallel to the axis L, is also usable. In such rolling mill roll, a contact pressure derived from a fitting section also fixes the rolling mill ring 11 on the metal base 12. Fitting methods, swell fit and/or shrinkage fit, are usable to fix them together. In other words, before inserting the metal base 12 into the rolling mill ring 11, the rolling mill ring 11 is pre-heated and/or the metal base 12 is pre-cooled.

Experiment 1

Figure 6:
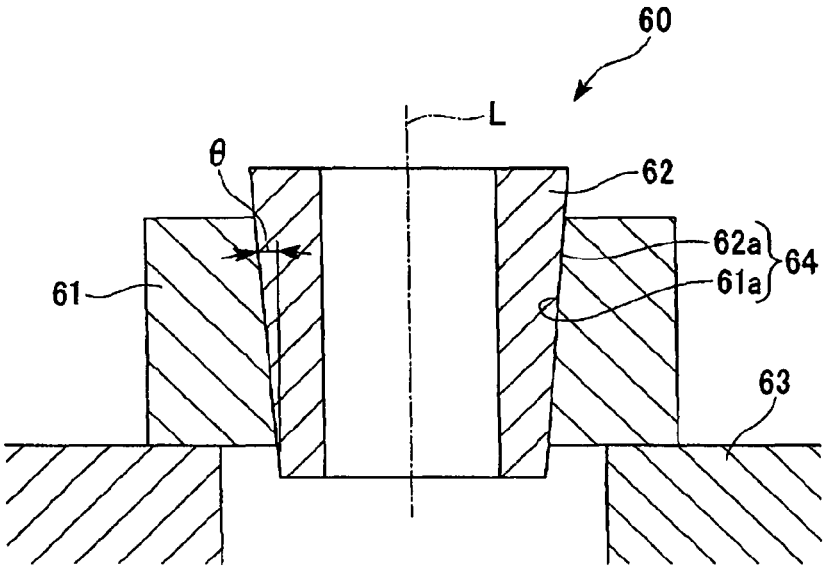
FIG. 6 shows a construction of examination equipment in outline used in the experiments 1 and 2.

To examine a contacting force fixing the rolling mill ring 11 and the metal base 12 in the aforementioned embodiment of the rolling mill roll 10, an experiment with an experimental equipment 60 shown in FIG. 6 was conducted on the cases wherein;

the contacting force was derived only from the contact pressure by wedging the metal base 12 into the tapered face, the contacting force was derived only from the adhesive strength of the adhesive agent M, and the contacting force was derived from both the above contact pressure and the adhesive agent M.

The experimental equipment 60 comprises a sample rolling mill ring 61, a sample metal base 62 having a cylindrical shape, and an experiment table 63 having a circular opening.

The sample rolling mill ring 61 is made of cemented carbide WC-15 wt % Co (equivalent to VU70), and its inner circumferential face 61*a* is a tapered surface in which its radial diameter becomes gradually smaller in the downward direction. This sample rolling mill ring 61 is located on the experiment table 63.

The sample metal base 62 is made of stainless steel SUS420J2, and its outer circumferential face 62*a* has a tapered shape in which its radial diameter becomes gradually smaller in the downward direction. The sample metal base 62 is wedged into the inner circumferential of the sample rolling mill ring 61.

Further, in the experimental equipment 60, the sample rolling mill ring 61 has dimensions wherein:

its length parallel to the axis L is set at 67.5 mm, the inner diameter of its upper rim is set at 89 mm, and the outer diameter of its upper rim is set at 158 mm.

Also, the sample metal base 62 has dimensions wherein:

its length parallel to the axis L will be longer than that of the sample rolling mill ring 61 for convenience of the experiment, and its inner diameter is set at 58.5 mm.

In this example, the taper angle θ of circumferential interface 64 comprised of the sample rolling mill ring 61 and the sample metal base 62, is set at 0°17'.

To conduct this experiment; by applying a force upwardly to the sample metal base 62 from its lower side, a pulling force; that is a force required to remove the sample metal base 62 from the sample rolling mill roll 61, and is equivalent to the above contacting force; was measured for the following three cases, i.e.;

a case in which the sample rolling mill roll 61 and the sample metal base 62 are fixed to each other by only the contact pressure derived from applying a pressure to the sample metal base 62 from its upper side, a case in which only the adhesive agent bound a circumferential interface 64 of the sample rolling mill roll 61 and the sample metal base 62 without applying any pressure, and a case in which the sample rolling mill roll 61 and the sample metal base 62 were fixed to each other by the above contact pressure together with the above adhesion agent.

The applied pressure for wedging was set at 19.6 N;

the movement of the sample metal base 62 by this pressure was set at 1 mm downwardly in the direction of the axis L; and then the fitting section was set at 0.01 mm.

Loctite (a registered trademark) 638 of Henkel Japan Ltd., its chief ingredient is a methacrylate ester and its shear strength is 22 N/mm$^2$, was used as the adhesive agent M.

Table 1 shows the result of this experiment.

In case of wedging only, the pulling force was 18.7 kN. In case of the adhesion agent only, the pulling force was 342.0 kN. In case of both wedging and adhesion agent, the pulling force was 473.0 kN. Therefore, for fixing the sample rolling mill ring 61 to the sample metal base 62, use of wedging and the adhesion agent made the pulling force greater than the sum of the pulling forces by wedging only and by the adhesion agent only.

This result showed that the use of both wedging and adhesion agent M was effective for fixing the rolling mill ring 11 and the metal base 12 firmly.

TABLE 1

| | Pulling force (kN) |
|---|---|
| Wedging only | 18.7 |
| Adhesion agent only | 342.0 |
| Wedging and adhesion agent | 437.0 |

Experiment 2

Next, to examine a correlation between the taper angle θ and the adhesion strength in the aforementioned embodiment of the rolling mill roll 10; a correlation between the taper angle θ of the circumferential interface 64 where the sample rolling mill roll 61 and the sample metal base 62 touch each other, and the adhesion strength of the adhesive agent M;

was measured with the same experimental equipment 60.

To conduct this measurement;

the same adhesive agent as mentioned in Experiment 1 was applied to each circumferential interfaces having various taper angles:

the sample metal base 62 was put and wedged into the inner circumference of the sample rolling mill ring 61 by applying downward force of 19.6 kN from the upper side of the sample metal base 62: and then the pulling force was measured by applying upward force to the sample metal base 62 from its lower side.

Specifically, this measurement was performed five times for each taper angle θ in the range of 0° to 3° at 0°10' intervals.

Figure 7:
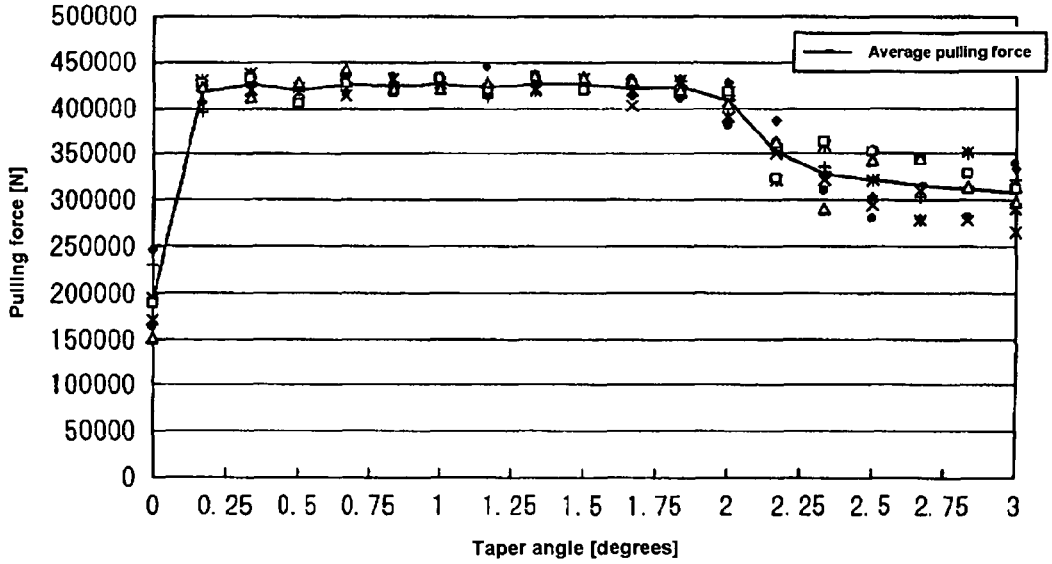
FIG. 7 is a graph which shows correlations between the taper angles and pulling forces, namely, forces required for pulling out the metal base from the rolling mill ring.

FIG. 7 shows the results of the measurements in the graph of the correlation between the pulling force and the taper angle θ.

In this graph, the horizontal axis shows the taper angle θ and the vertical axis shows the pulling force, respectively. In case the taper angle was 0°, since the adhesive agent M came off when inserting the metal base into the rolling mill ring, a great pulling force was not available.

However, in case that the taper angle θ was in the range of 0°10' to 2°00', a great pulling force was stably available.

Further, in case that the taper angle θ was over 2°00', deviations of each pulling force increase and also each pulling force gradually became poor in accordance with the increase of the deviations.

Therefore, this result showed that, in the rolling mill roll 10, the taper angle determined in the range of 0°10' to 2°00' made stably the rolling mill ring 11 and the metal base 12 the single unit securely.

INDUSTRIAL APPLICABILITY

In the rolling mill roll comprised of a rolling mill ring and a metal base as a single unit, the fitting section formed at the circumferential interface and the adhesive agent applied thereto can make the rolling mill ring and the metal base the single unit securely.

Further, the tensile stress applied to the rolling mill ring located on the outer circumferential face section can be reduced.

Especially, the outer circumferential face of the rolling mill roll is free from cracking, even if the rolling mill roll is used with an overhung type rolling mill machine.

In other words, the outer circumferential face of the rolling mill roll is free from cracking, even if the inner circumferential face of the rolling mill roll is pressed radially outward when fixing the rolling mill roll on the rolling mill machine for using them together.

The invention claimed is:

1. A rolling mill roll comprising:

a rolling mill ring made of cemented carbide having one or more rolling mill sections for milling work piece on its outer circumferential face;

a ring shaped metal base located in an inner circumferential region of the rolling mill ring below the rolling mill ring on a line with the rolling mill ring perpendicular to a rotating axis of the rolling mill ring; and a tapered sleeve below the ring shaped metal base on said line perpendicular to the rotating axis;

wherein a circumferential interface, where the rolling mill ring and the metal base face each other, is fixed radially around its axis by a contact pressure derived from a fitting section, and also is bound with an adhesive agent, wherein, the circumferential interface is a tapered face which slopes to the axis and is fixed with the contact pressure by wedging the metal base into the rolling mill ring, and wherein, a taper angle, at which the circumferential interface slops to the axis, is in the range of 0°10' to 2°00'.

2. A rolling mill roll according to claim 1, wherein, the agent is a methacrylate resin type adhesive agent.

3. A rolling mill machine comprising:

a rolling mill roll comprising:

a rolling mill ring made of cemented carbide having one or more rolling mill sections for milling work piece on its outer circumferential face;

a ring shaped metal base located in an inner circumferential region of the rolling mill ring below the rolling mill ring on a line with the rolling mill ring perpendicular to a rotating axis of the rolling mill ring; and a tapered sleeve below the ring shaped metal base on said line perpendicular to the rotating axis;

wherein a circumferential interface, where the rolling mill ring and the metal base face each other, is fixed radially around its axis by a contact pressure derived from a fitting section, and also is bound with an adhesive agent, wherein, the circumferential interface is a tapered face which slopes to the axis and is fixed with the contact pressure by wedging the metal base into the rolling mill ring, and wherein, a taper angle, at which the circumferential interface slops to the axis, is in the range of 0°10' to 2°00';

wherein the rolling mill roll is mounted coaxially on the outer circumferential face of the tapered sleeve; and wherein the rolling mill machine further comprises a tapered shaft section below the tapered sleeve which rotates on its axis, wherein the tapered sleeve has a tapered inner circumferential face, and the tapered sleeve is mounted on the tapered shaft section.

4. A rolling mill machine according to claim 3, wherein the adhesive agent is a methacrylate resin type adhesive agent.

* * * * *